US006561860B2

(12) United States Patent
Colyvas

(10) Patent No.: US 6,561,860 B2
(45) Date of Patent: May 13, 2003

(54) MANEUVERING ENHANCER FOR TWIN OUTBOARD MOTOR BOATS

(76) Inventor: Constantine N. Colyvas, 59 Valorie Rd., Southampton, NY (US) 11968

( * ) Notice: Subject to any disclaimer, the term of this patent is extended or adjusted under 35 U.S.C. 154(b) by 0 days.

(21) Appl. No.: 09/841,138

(22) Filed: Apr. 24, 2001

(65) Prior Publication Data

US 2002/0086594 A1 Jul. 4, 2002

Related U.S. Application Data

(60) Provisional application No. 60/241,260, filed on Oct. 18, 2000.

(51) Int. Cl.[7] ..... B63H 5/125
(52) U.S. Cl. ..... 440/61; 440/63
(58) Field of Search ..... 440/53, 63, 61; 114/144 R

(56) References Cited

U.S. PATENT DOCUMENTS

| | | | | | |
|---|---|---|---|---|---|
| 3,881,443 | A | * | 5/1975 | Hamp | 248/640 |
| 3,983,834 | A | * | 10/1976 | Hirmann | 114/144 R |
| 4,573,930 | A | * | 3/1986 | Queen | 403/235 |
| 4,776,819 | A | * | 10/1988 | Yamamoto et al. | 440/61 |
| 4,778,418 | A | * | 10/1988 | Mondek | 440/63 |

* cited by examiner

*Primary Examiner*—Stephen Avila

(57) ABSTRACT

An adjustable length bar to replace the rigid bar, the one connecting the two outboards or the two outdrives of a boat, for steering purposes, said adjustable bar being electricly operated through a switch on the boat's dashboard, said switch having two operating positions, one to keep propellers creating two parallel thrusts (cruising mode), and a second to shift the propellers to create a vee configuration (maneuvering mode), by which the boat's maneuverability will be enhanced.

2 Claims, 9 Drawing Sheets

MANEUVERING ENHANCER FOR TWIN OUTBOARD MOTOR BOATS

CROSS-REFERENCE TO RELATED APPLICATION

This application is entitled to the benefit of Provisional Patent Application Ser. No. 60/241,260 filed Oct. 18, 2000.

BACKGROUND OF INVENTION

1. Field of Invention

This invention relates to a device for boats with twin outboard motors (O/Bs), or twin inboard outdrives(I/Os).

2. Description of Related Art

It is a well known fact that boats with twin O/Bs or twin I/Os have difficulties in maneuvering in close quarters, especially when attempting to turn the boat around before berthing, due to the fact that these O/Bs and or I/Os are, for steering purposes, connected together with a rigid bar, in a way that both propellers create the same parallel thrusts.

This is a disadvantage, when the operator, during maneuvering wants to turn his boat around, in narrow channels and other conjested places, with the usual maneuver of running one engine ahead and the other astern, the two propeller thrusts, on almost the same axis and so close together, actually counteract each other, with minimum turning effect. This is more obvious when there is some adverse wind or current.

BRIEF SUMMARY OF INVENTION

The device that we will describe hereunder tends to eliminate this disadvantage, by shifting the direction of the propeller thrusts, during maneuvering, in a way that the propeller thrusts, instead of opposing each other's effect, will now assist each other, in a combine effort to turn the boat around and in any other tight maneuver.

This device is an adjustable length bar, that will replace the existing rigid bar, the one connecting the two O/Bs, or two I/Os.

The desired results of this device can be accomplished by two methods

1. Install the motors on the boat as far apart as permitted by the manufacturer. Have the control switch and circuitry arranged so that when the switch is placed on the "Maneuvering Mode," said adjustable bar will expand, to the maximum permitted length, to turn the propeller thrust directions inward, forming an inverted v configuration, with propeller hubs angled toward each other, but with sufficient clearance to keep the two propellers safely apart. In this configuration, when the usual maneuvering For turning the boat to port (left) is executed, by placing the starboard engine ahead (forward) and the port astern (reverse), the propeller thrusts will assist each other to turn the boat in the required direction.
2. A narrow spacing method is for boats in which the engines cannot be installed further apart. This method however, requires the use of an Electric Gear Shift Control. An additional Counter Rotation Solenoid Switch is connected, to bring the required results.

DESCRIPTION OF PRIOR ART

The twin O/Bs and twin I/Os are presently connected together, for steering purposes, by a rigid bar. This is a disadvantage because, the two propellers are always creating two parallel thrusts, and during maneuvering, to turn the boat around, in narrow channels and other conjested places, the two propellers counteract, instead of helping each other, which we believe, our adjustable length bar will correct.

DETAILED DESCRIPTION

Figure 1:
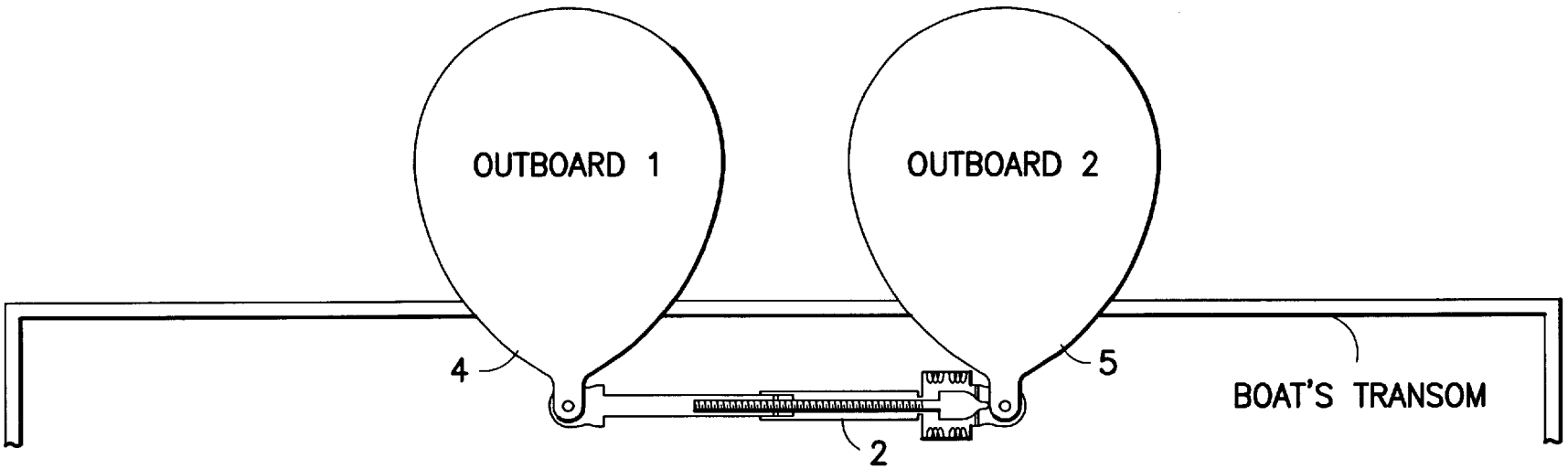
FIG. 1 is a plan of a boat's transom, showing both outboard motors linked by the adjustable bar of the present invention.
Figure 1A:
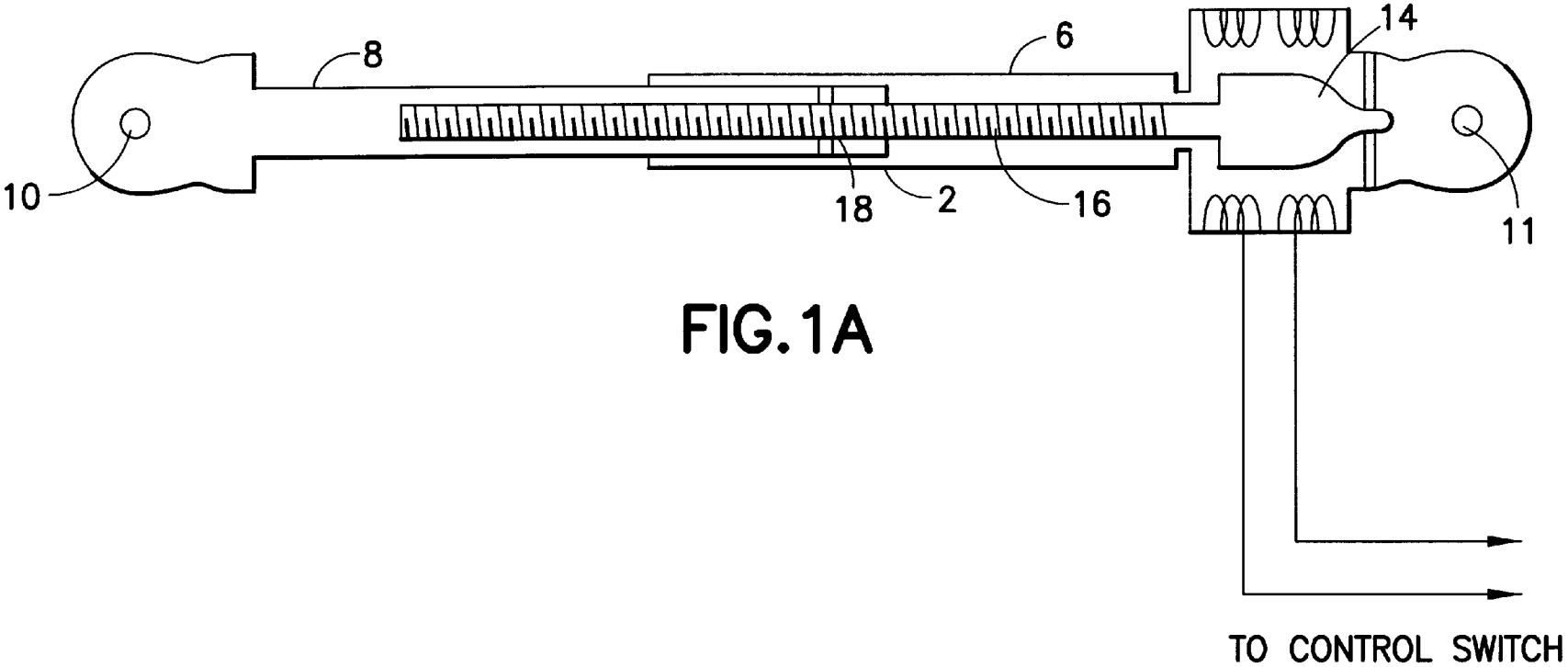
FIG. 1A is an enlarged plan view of said adjustable length bar.

As in FIG. 1, this device is an adjustable length bar 2, that will replace the existing rigid bar, the one connecting the two O/Bs 4, 5 or IOs. As in FIG. 1A, this adjustable bar 2, comprises:

Two tubular pieces, one hollow 6 and one solid 8, that fit tightly inside each other, but which are easy to slide in and out, with eye holes at the ends 10 and 11, for securing to the motors 4–5.

A reversible electric motor 14, with a long threaded shaft is attached inside the end of the hollow part of the bar, and a suitable threaded hole 18 is opened inside the solid par 8 of the bar, to accomodate the long threaded shaft 16 of the electric motor.14.

Figure 2:
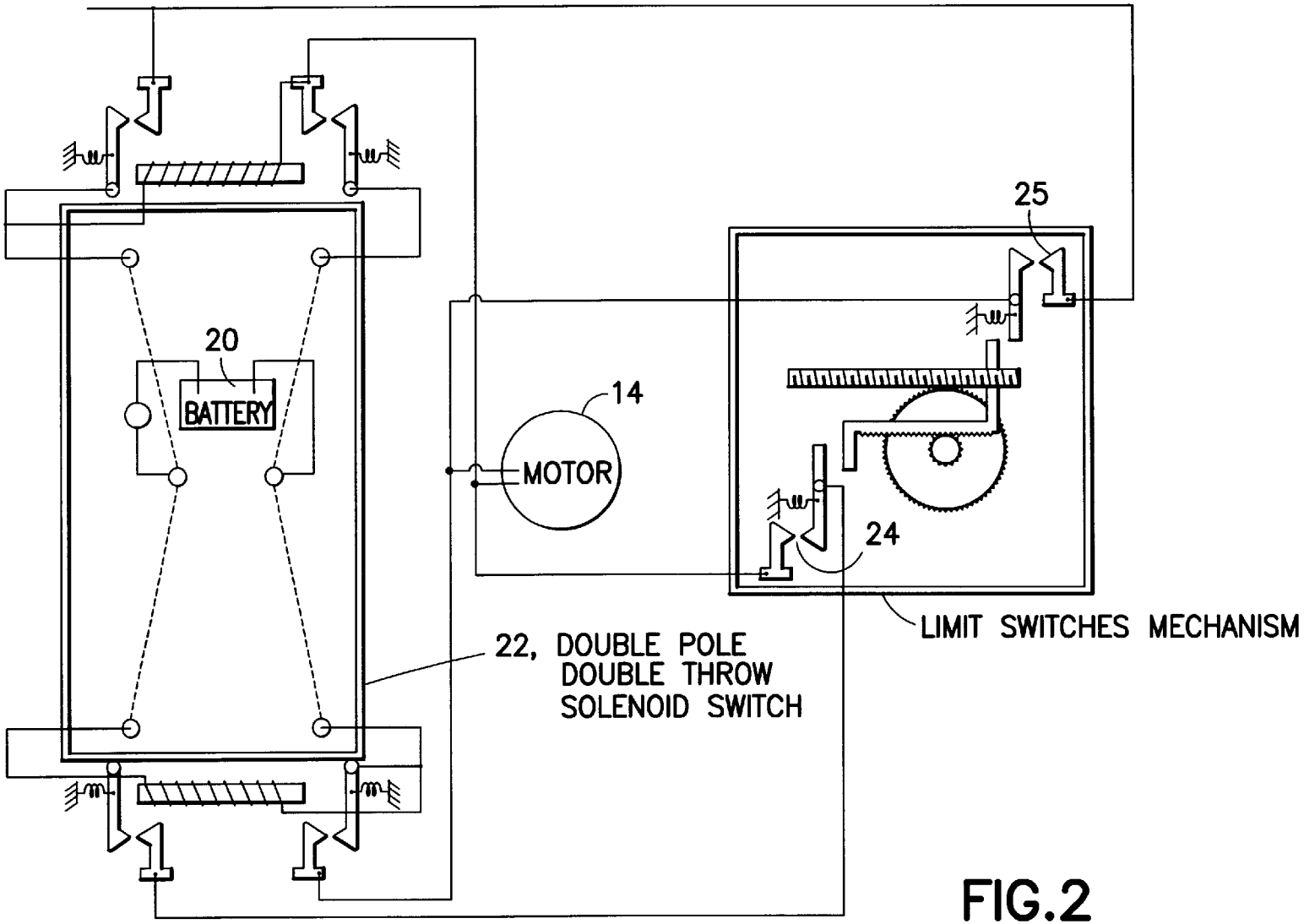
FIG. 2 is an electrical mechanical schematic of the control circuit for adjusting the bar.

As in FIG. 2, Motor is electricly connected to the boat's battery 20, through a double-pole-double throw solenoid switch 22, as shown in the attached FIG. 2. Limit switches 24–25, as in FIG. 2, control the extension and retraction of the adjustable bar, as required.

The adjustable bar can also be made to work hydraulically, instead of mechanically, as above described, with same results.

Figure 3:
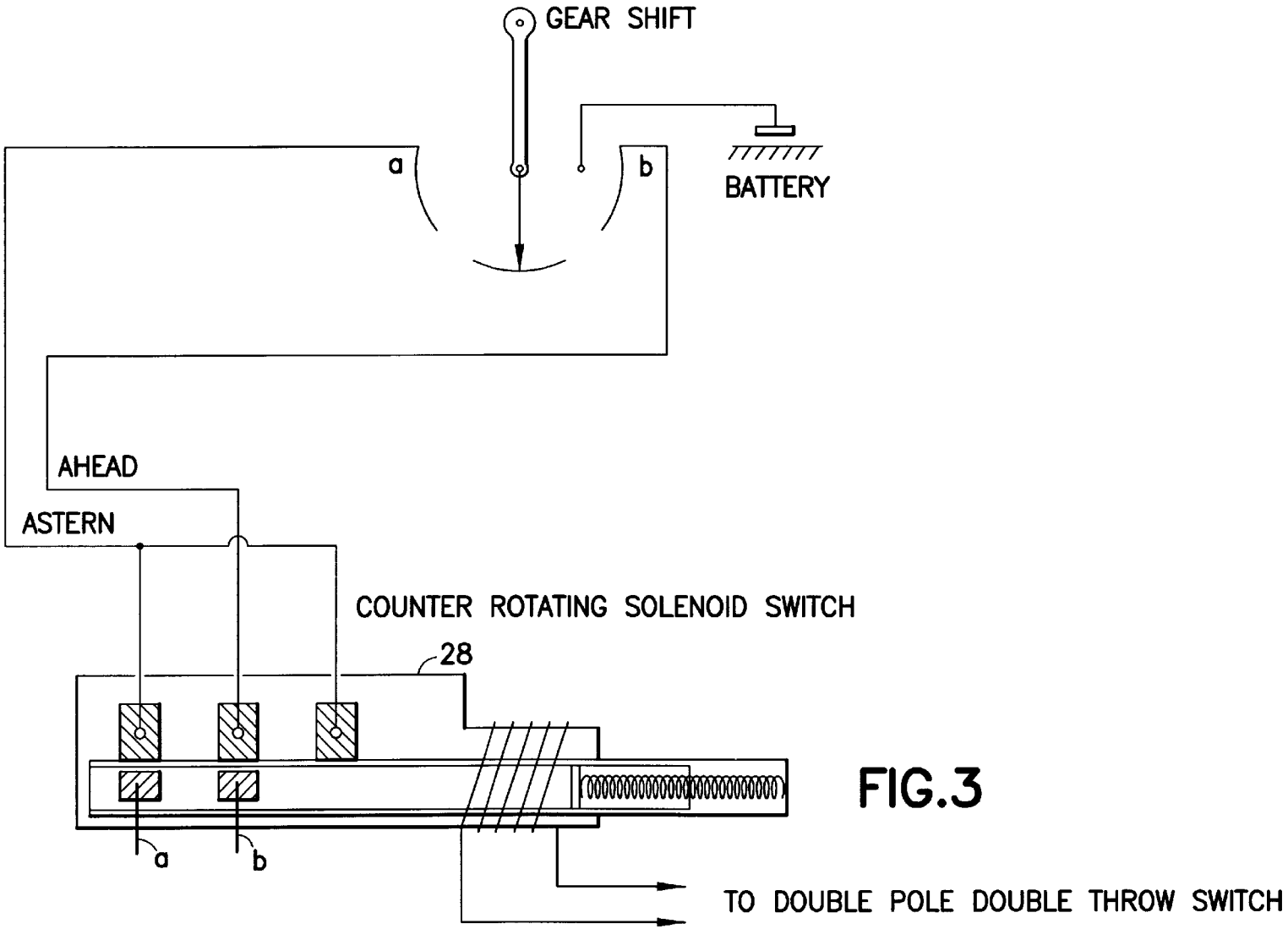
FIG. 3 is an electrical schematic of the counter rotation solenoid switch, in cruising mode.

FIG. 3 shows the embodiment designed to work in boats equiped with electric gear shift control. The additional Counter Rotation Solenoid Switch 28 is also connected, to bring the favorable results required. FIG. 3 shows solenoid 28 in cruising mode.

Figure 3A:
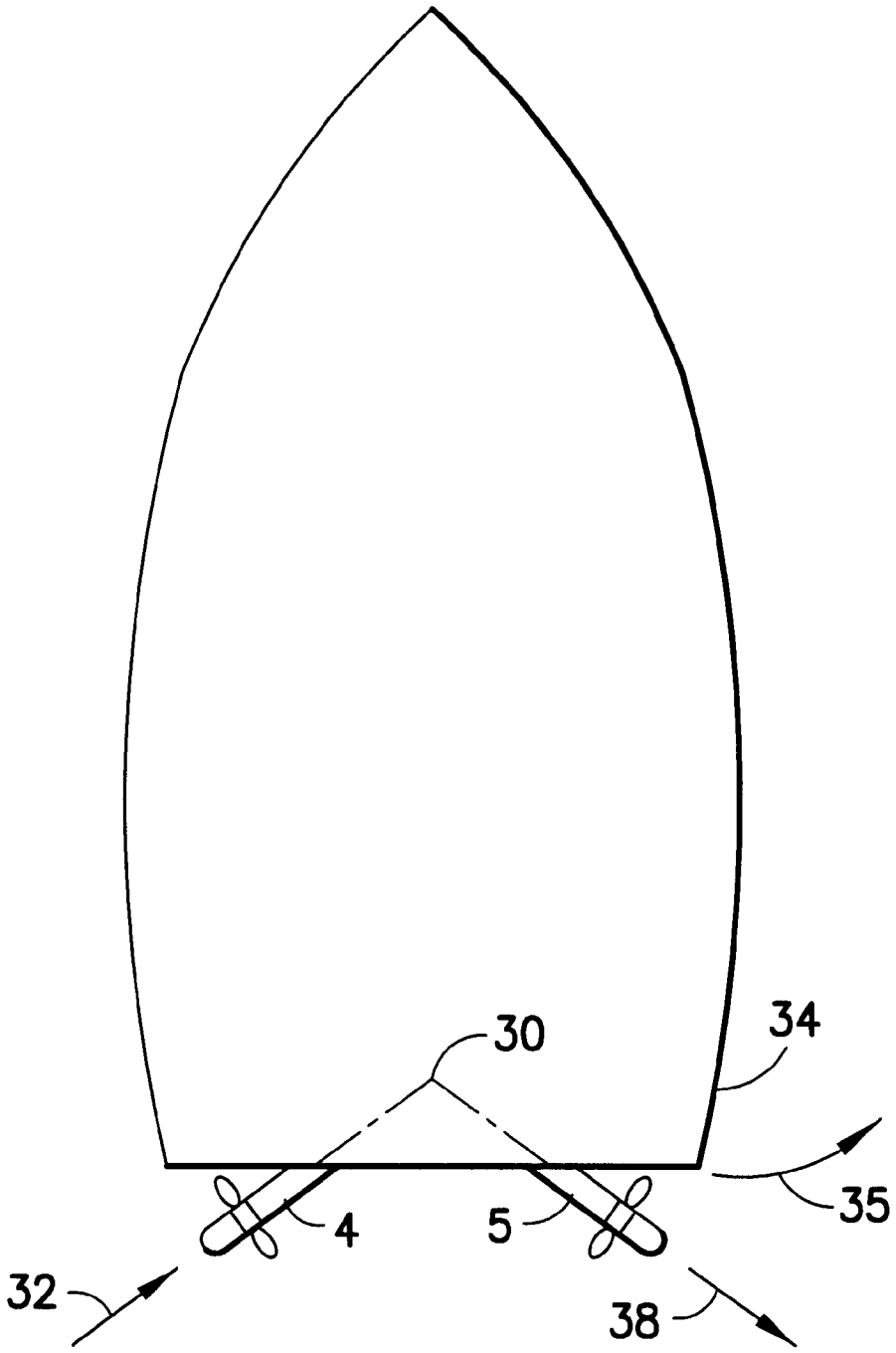
FIG. 3A is a plan view of a power boat showing a narrow configuration in maneuvering mode.
Figure 4:
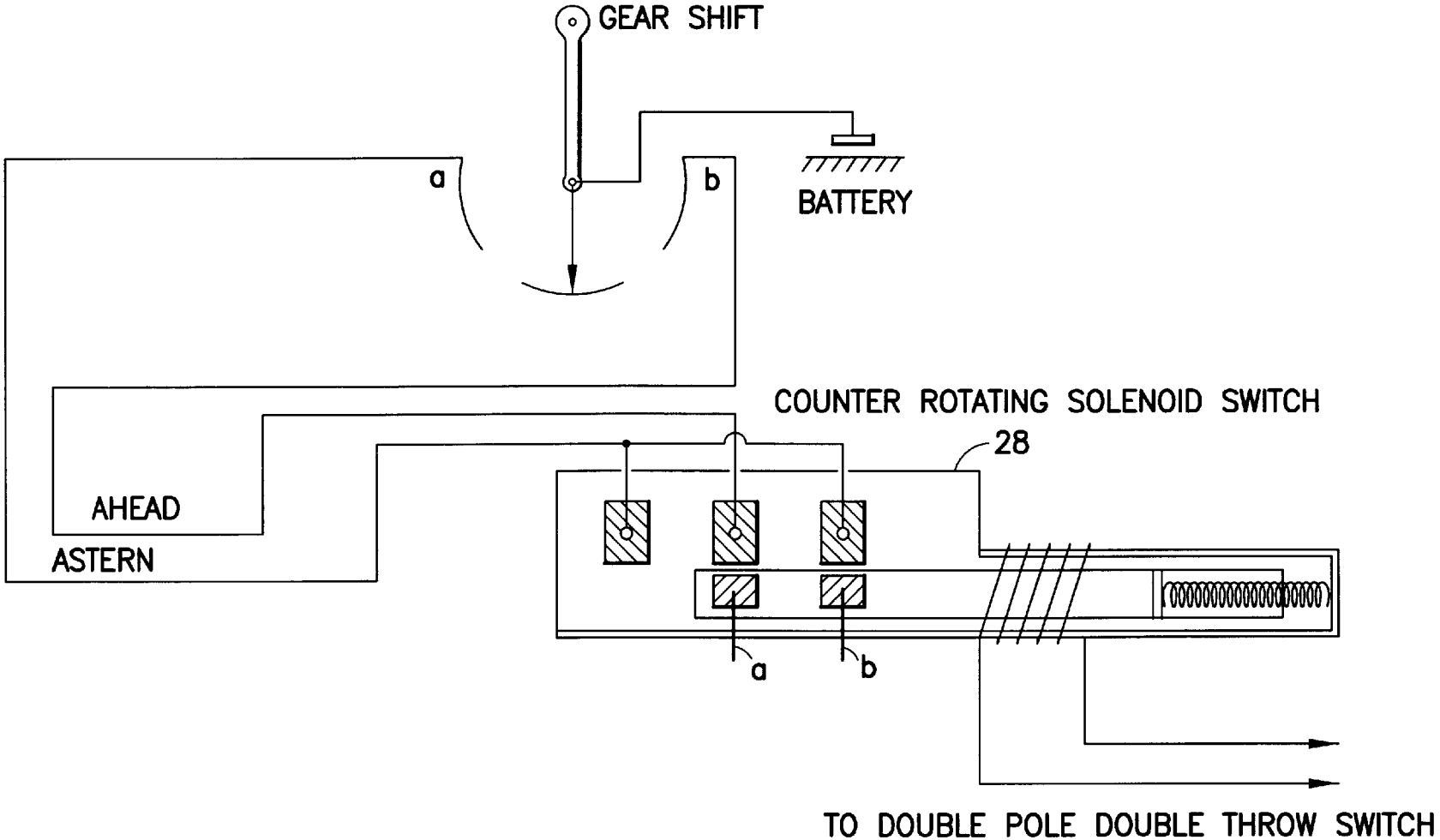
FIG. 4 is an electrical schematic showing the counter rotation solenoid in the maneuvering mode.

In FIG. 4 solenoid 28 is energized by the double-pole-double-throw switch and reverses the rotation of the engine propellers. If for example, the starboard shift lever was put ahead, to turn the bow to port, the starboard engine now will go astern, as FIG. 3A, and with the port lever shifted astern, the port engine will now go ahead instead of astern. In FIG. 3A, because of the wide Vee angle 30 of the propeller thrusts, thrust 32 of the port engine 4 now will push the boat's stern 34 to starboard 35 and the starboard engine 5, now going astern, will pull 38 the stern 34 also to starboard 35. The two forces 32,38 helping each other, instead of counteracting.

Figure 5:
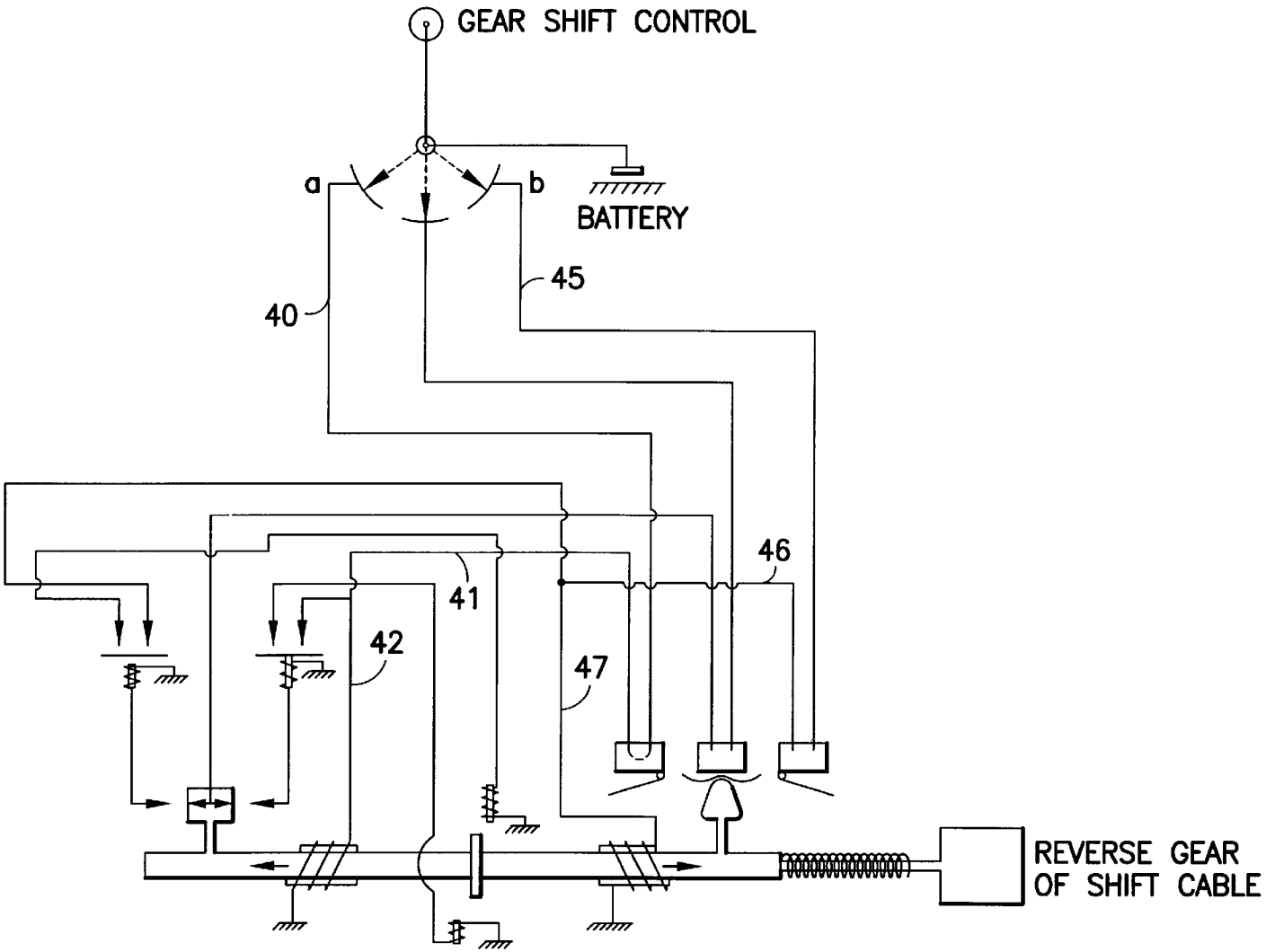
FIG. 5 is an electrical schematic of the electric gear shift control, when shifting gear from neutral to forward or reverse

The FIG. 5 circuit is a complete Gear Shift Control. The circuit 40–42 shows when the Gear Shift Control is put on Reverse and circuit 45–47 is when the lever is put on Forward.

The double-pole-double-throw switch can be simplified, by having a spring return to its original position when the control switch is brought back to cruising position and the current on the solenoid is cut off.

Figure 6:
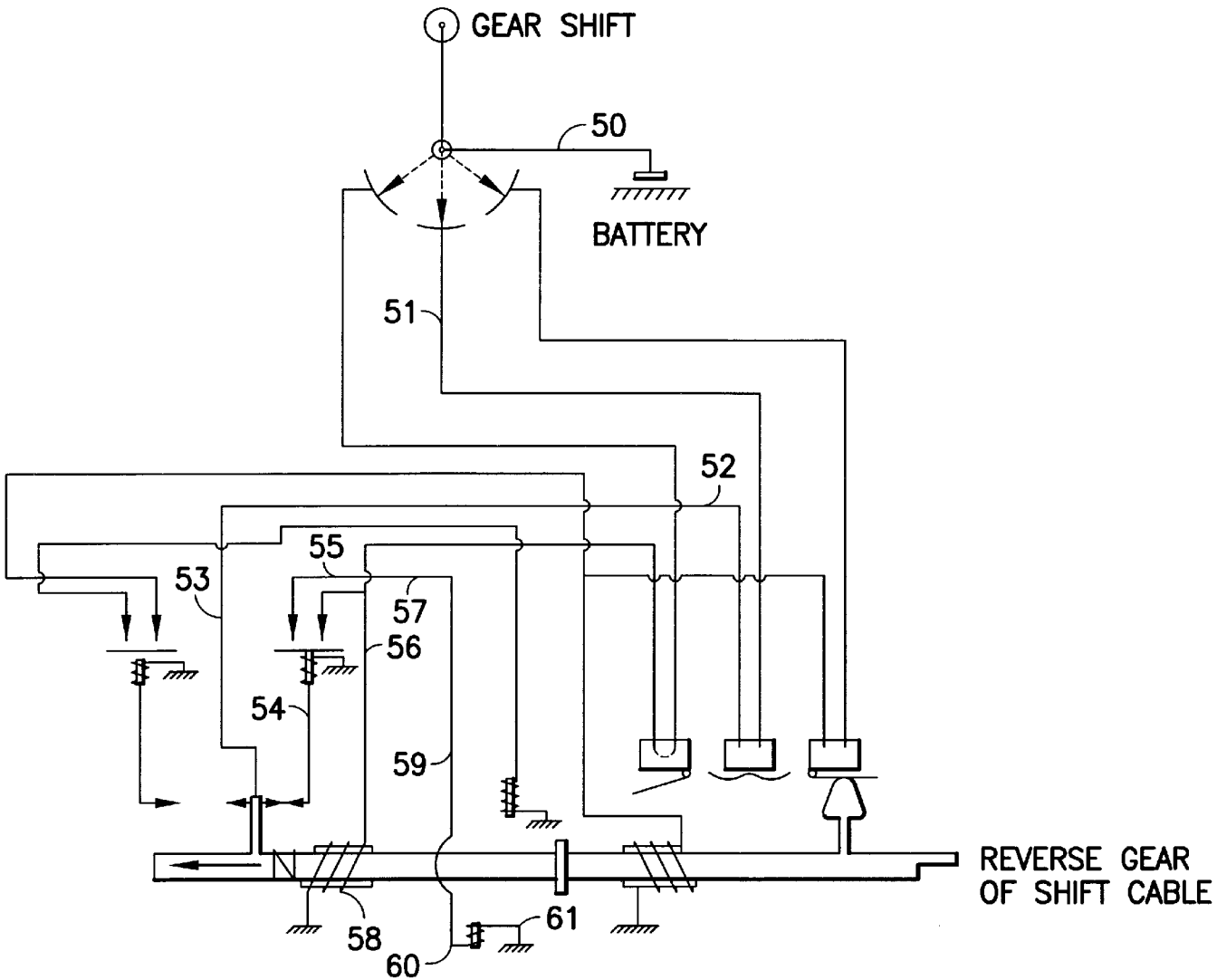
FIG. 6 is an electrical schematic of the electric gear shift control when shifting gear from reverse to neutral.
Figure 7:
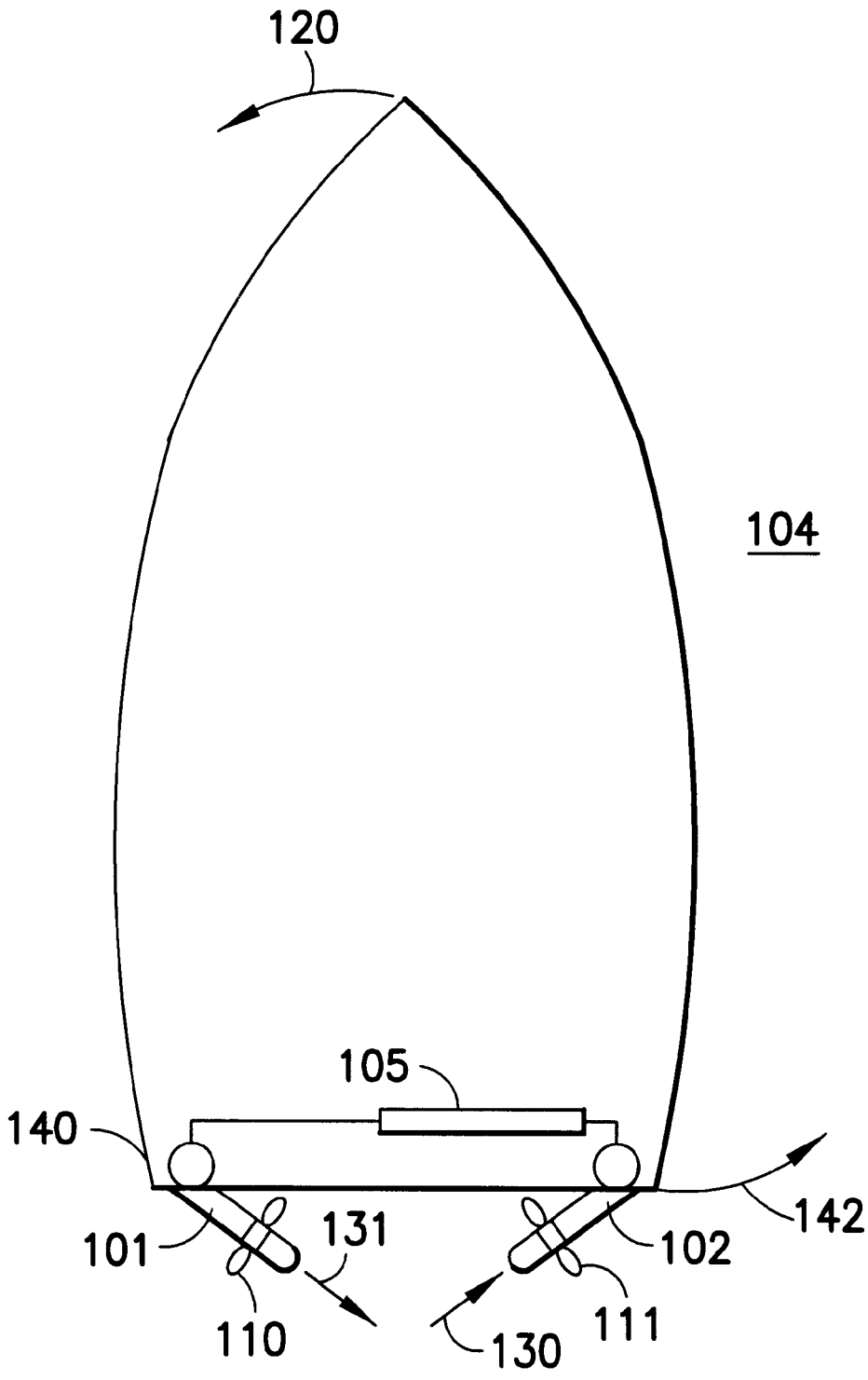
FIG. 7 is a plan view of a motor boat, using a wide space O/B or I/O configuration, in which the propellers are angled inward, in the maneuvering mode.

FIG. 6 shows the elements 50–61 energized and how they act, when the gear lever is moved from Reverse to Neutral. Please note the stopper solenoid 61, which is also energised now, to stop the gear shift movement at the exact neutral position.

In order to enable the maneuvering configuration, the connections a and b (FIG. 3) are first connected to the counter rotation solenoid switch and the wires from the moving bar poles continue to complete the circuit.

With this modification, replacing the existing rigid bar, with our adjustable bar 2 and components, the boat's operator, when in a maneuvering area, will be able, with the flip of a switch, to change the motors's parallel propeller thrusts, to, as in FIG. 3A, a wide Vee angle 30 thrusts, resulting in a faster turn around and easier control and berthing of his boat.

Electric Switches in the limit control box, will be connected to a green pilot light, indicating the system is on CRUISING Mode, or to a red Flashing light, indicating the MANEUVERING Mode on the boat's dashboard.

WIDE EMBODIMENT

The wide spread motor configuration is shown in Fi.7. Install the motors 101–102 on the boat 104 as far apart as permitted by the manufacturer. Have the Control Switch and circuitry arranged so that when the switch is placed on the "Maneuvering Mode," the bar 105 will expand, to the maximum permitted length, to turn the engines and propeller thrusts directions forming an inward V configuration, but keep the two propellers 110–111 safely apart from each other.

In this configuration, when the usual maneuver for turning the boat to port (left) is executed, by placing the starboard engine 102 ahead(Forward) creating force 130 on the boat, and the port engine astern, creating force 131, the propeller thrusts will assist each other, to turn the boat on the required port direction 120, by turning the stern 140 to starboard 142.

OBJECTS AND ADVANTAGES

It is to be noted that, on both engine configurations the same engine maneuver is required for turning a boat. This we believe is important for not confusing boat operators, especially that the described maneuver is the long existing maneuver for turning boats and well known to all mariners.

I claim:

1. A device for enhancing maneuverability of a boat, equipped with two outboard engines or two inboard-outdrives, comprising:

a. an adjustable length bar, to replace the existing rigid bar, connecting the two outboards, or two outdrives b. said adjustable length bar being electricly operated through a switch on the boat's dashboard c. said switch having two positions d. one position having the propellers create parallel thrusts and e. a second position to shift the propellers to create a prearranged vee configuration thrusts.

2. A device for enhancing maneuverability of a boat, according to claim one, comprising:

a. An adjustable length bar, to replace the existing rigid bar, connecting the twin outboards, or twin outdrives, b. Said adjustable length bar, being hydraulically operated, through an electric switch, on the boat's dashboard, c. Said switch having two positions, d. One position having the propellers create parallel thrusts e. And a second position, to shift the propellers to create a prearrange Vee configuration trusts.

* * * * *